United States Patent [19]

Knowles et al.

[11] 4,242,975

[45] Jan. 6, 1981

[54] NEEDLE SUPPORT MEANS

[75] Inventors: Warren D. Knowles, Clark; Lionel J. Coulombe, Matawan, both of N.J.

[73] Assignee: The Singer Company, Stamford, Conn.

[21] Appl. No.: 114,165

[22] Filed: Jan. 22, 1980

[51] Int. Cl.[3] ..... D05B 55/02

[52] U.S. Cl. ..... 112/226

[58] Field of Search ..... 112/226, 222, 223, 224, 112/225

[56] References Cited

U.S. PATENT DOCUMENTS

| | | | |
|---|---|---|---|
| 2,973,733 | 3/1961 | Johnson | 112/226 |
| 3,277,854 | 10/1966 | Casas-Robert | 112/226 |
| 3,344,761 | 10/1967 | Ross | 112/226 |
| 3,513,793 | 5/1970 | Dohr | 112/226 X |

*Primary Examiner*—Peter P. Nerbun

*Attorney, Agent, or Firm*—Donald P. Gillette; Robert E. Smith; Edward L. Bell

[57] ABSTRACT

A support structure is provided for a sewing machine needle. The structure includes a simplified needle bar 14 having a solid end 34 with a transverse, threaded hole 36. A die cast needle clamp 11 is precision-formed with a hollow cylinder 13 that fits over the end of the bar and is attached by a screw 16. A needle channel 19 is cast in the clamp to hold the shank 22 of a needle with the flat surface of the shank against a flat surface 21 of the channel and the round part of the shank captured between another flat surface 32 and the conical end of a screw 23. The cross section of the channel 19 is large enough to receive standard needles but not so large as to receive the shank of the smallest standard needle improperly oriented.

7 Claims, 5 Drawing Figures

Fig.1
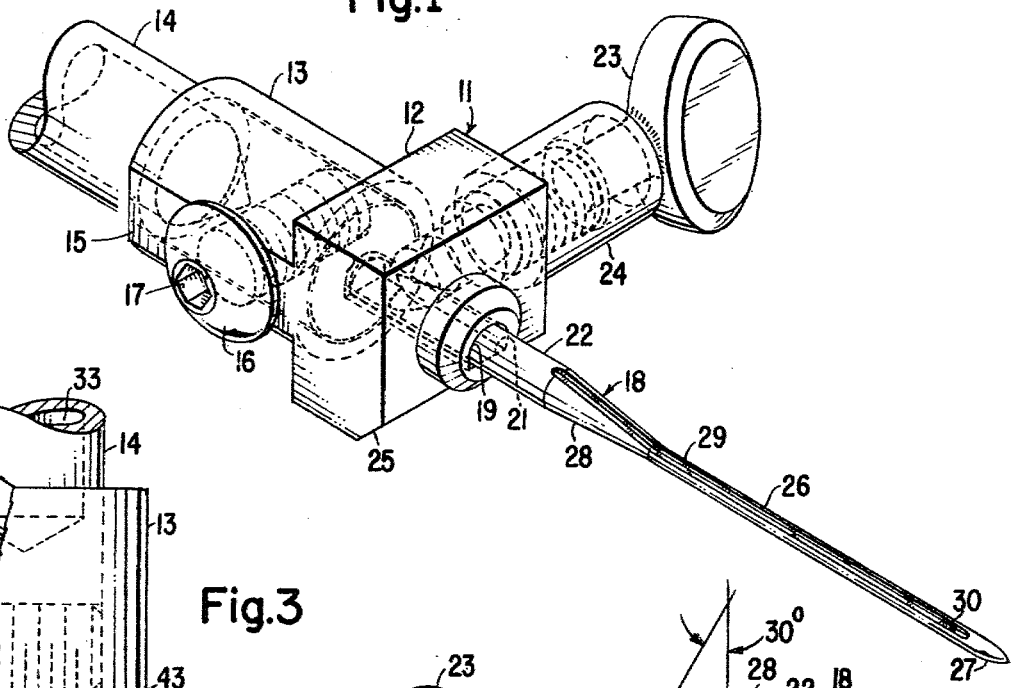
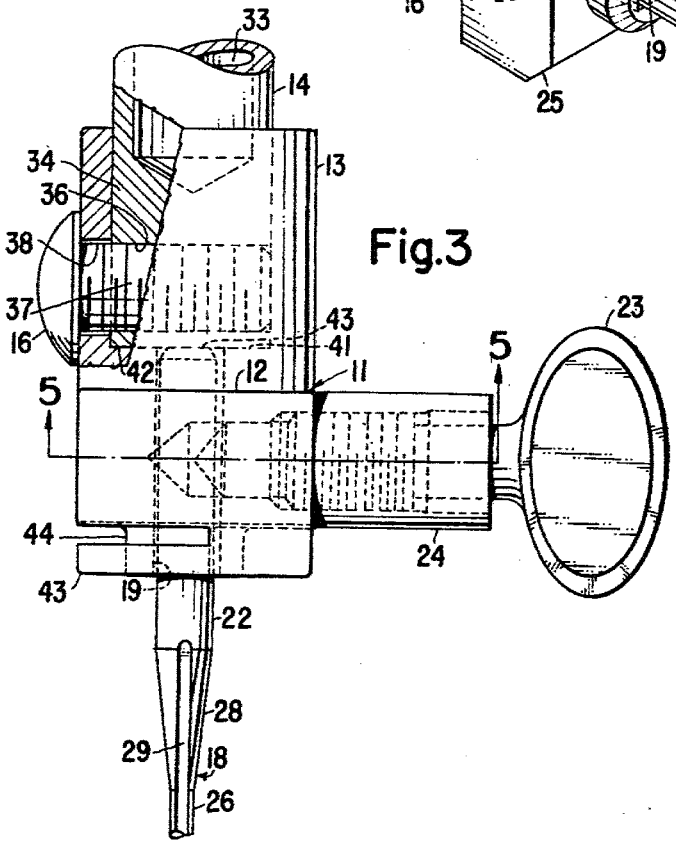
Fig.3
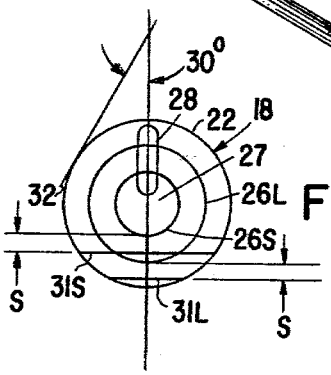
Fig.2
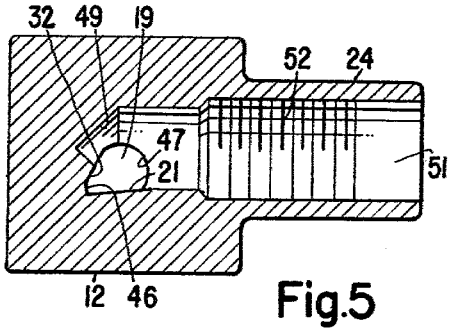
Fig.5
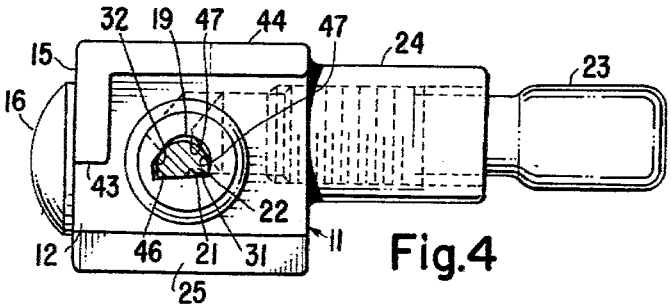
Fig.4

NEEDLE SUPPORT MEANS

DESCRIPTION

BACKGROUND OF THE INVENTION

This invention relates to a simplified needle clamp and needle bar assembly that can be produced at a substantially lower cost than needle clamps and assemblies currently being made. In particular, the invention relates to a needle clamp of die cast zinc with a hardening plating layer and with a needle hole precision-formed so as to accept standard sewing machine needles of any size from #9 through #18 in only the proper orientation.

Needle bar clamps are currently made by machining the entire structure from a solid piece of steel. This structure includes a main body portion in the form of a block having a tubular part that extends upwardly and surrounds the lower end of the needle bar. A tubular side lug is formed and is internally threaded to receive a thumb screw that holds the needle in place by pressure of the end of the thumb screw on the shank of the needle.

The clamp is held in place on the end of the needle bar by means of a machine screw in a threaded hole near the lower end of the needle bar. In order to hold the needle in only one orientation in the end of the needle bar, a slot is milled into the lower end of the needle bar.

A sewing machine needle of the type most commonly used has a shank in the shape of a circular cylinder with a cylindrical segment removed. The resulting flat surface is aligned in a predetermined angular position with respect to other parts of the needle and is used as a guide in orienting the needle properly in the clamp. Needles of different size all have shanks of the same diameter, approximately 0.081", or 2.060 mm. The thickness of the shank in the direction perpendicular to the flat surface depends on the size of the blade of the needle and may be as small as 0.055", or 1.400 mm., for a #9 needle to as large as 0.064", or 1.630 mm, for a #18 needle. The width of the slot is large enough to receive the shank of the largest needle of a standard size, and the bottom wall of the slot is a planar surface at an angle of 30° with respect to one of the side surfaces of the slot and, therefore, 120° with respect to the other side surface. The flat surface portion of the shank is forced against the first side wall of the slot, and the round part of the shank is forced against the bottom wall by the screw that holds the needle in place.

In order to make certain that the needle can fit into the slot in only one position, a transverse slot is also milled into the needle bar just above the lower extremity, and a device called a gib is fitted into this transverse slot. The outermost surface of the gib is a segment of a circular cylinder of substantially the same diameter as the needle bar. Viewed axially, the gib is approximately wedge shaped, with the point of the wedge milled away to form a partially cylindrical concave surface that fits around the round part of the shank of the needle.

Typically, the cylindrical portion of the needle clamp that fits around the lower end of the needle bar also has a transverse slot to receive part of a thread guide formed from a metal strap that has an aperture at one end through which the screw fits to hold the needle clamp in place on the needle bar. The other end of the thread guide is bent into a loop, part of which fits into the slot formed in the cylindrical part of the needle bar clamp.

U.S. Pat. No. 2,973,733 shows a needle clamp substantially as just been described except that it does not have a gib since it was intended to provide space for two needles side by side in the slot. However, without the gib, the needle, or needles, can be put into the slot facing exactly in the wrong direction. The same possibility exists in U.S. Pat. No. 3,513,793, which is a modified form of the needle clamp shown in U.S. Pat. No. 2,973,733, and in U.S. Pat. No. 3,344,761.

U.S. Pat. No. 3,277,854 shows a needle clamp with a gib, but the gib has a flat surface facing the needle, and the slot that receives the needle in the lower end of the needle bar is wide enough to allow the needle be inserted so that it faces the wrong direction.

Needle clamps, as made heretofore, have required a considerable amount of machining. Commonly, the clamps are machined out of a single piece of metal stock, and a number of repositionings of the stock are required in order to carry out all of the machining steps necessary. In addition, the needle bar, itself, must have the slot machined in it in the longitudinal direction to receive the needle and the transverse slot to receive the gib must also be machined. The gib must be machined as a separate piece and assembled carefully with the needle bar so as to be in the proper position rather than the inverted position. This assembly is a rather delicate operation, since the gib is not only small but has no projections that allow it to be held easily while the clamp is slid onto the end of the needle bar and over the gib to hold the latter in place.

OBJECTS AND SUMMARY OF THE INVENTION

It is one of the objects of this invention to provide an improved needle clamp for a sewing machine.

Another object is to provide a clamp in the form of a unitary structure that can easily be assembled in the proper position on the end of a needle bar and into which a needle of any of the standard sizes can be fitted only with the proper orientation.

Still another object of this invention is to provide a zinc die cast needle clamp.

A further object of the invention is to reduce, substantially, the cost of needle clamps and needle bar assemblies for sewing machines.

Further objects will be apparent from the following specification together with the drawings.

In accordance with the present invention, a needle clamp is die cast of zinc as a precisely formed, unitary structure that has a main body portion with a hollow cylindrical part that fits over one end of a cylindrical needle bar. The clamp has a needle channel into which a needle can be inserted longitudinally aligned with the needle bar. The cross section of the needle channel is such that any of the standard needle shanks can fit into it, but even the smallest standard shank (for a #9 needle) cannot be fitted in any other orientation than the correct one. The needle clamp is formed with a side lug that has an internal screw thread into which the usual thumb screw can be inserted to be tightened against the needle shank in order to hold the needle firmly in place in the clamp. At least the surface of the side lug, and preferably the entire needle clamp, has a hardening coating on it. It is necessary to make the lug wear-resistant because it is used as a driving member for various types of sewing machine attachments, as is commonly known. A suitable wear-resistant coating is a chromium plating, and it is preferable to apply this plating over the entire exposed surface of the clamp.

BRIEF DESCRIPTION OF THE DRAWINGS

The invention will be described in greater detail in connection with the drawings in which:

FIG. 1 is a perspective view of a needle clamp and needle assembled on the end of a needle bar of a sewing machine;

FIG. 2 is a simplified end view representing two needle sizes and illustrating certain dimensions common to needles;

FIG. 3 is a front elevational view of the needle clamp in FIG. 1 and a portion of the needle and needle bar;

FIG. 4 is a bottom view of the needle clamp in FIG. 3; and

FIG. 5 is a cross sectional view of the needle clamp in FIG. 3 along the line 5—5.

DETAILED DESCRIPTION OF THE PREFERRED EMBODIMENT

FIG. 1 shows a needle clamp 11 according to this invention and comprising a body portion 12 with a hollow cylinder 13 extending from one side. The end of a needle bar 14 is inserted into the hollow cylinder and is held therein by a screw 16 having a hexagonal receptacle 17 to receive a matching hexagonal wrench. A flat surface 15 is formed on the cylinder 13 to provide better engagement with the head of the screw 16. The position in which the needle clamp 11 is shown has been selected as the one that best illustrates the construction of the clamp; in normal use, the needle bar 14 is vertical, or almost so, and the clamp is attached to the lowermost end of the bar.

A typical sewing machine needle 18 is attached to the clamp by being inserted into a needle channel 19 that extends through the body portion 12 and into the open cylinder 13. The cross sectional shape of the needle channel 19 will be described in detail in connection with FIGS. 4 and 5, but it is sufficient at this point to indicate that it has a flat surface 21 against which a flat part of the shank 22 of the needle is pressed. The pressure necessary to hold the needle 18 in this position is furnished by a thumb screw 23 threaded into a side lug 24 that extends from one side of the body portion 12. One edge of the body 12 is beveled off to form a sloping surface 25 to allow clearance for a presser foot (not shown) when the clamp 11 is in use.

The needle 18 has, in addition to the shank 22, a blade 26 terminating in a point 27. The needle is formed with a tapered section 28 between the shank 22 and the blade 26, and a groove 29 extends along the tapered section 28 and the blade 26 to an eye 30 near the point 27 at the end of the blade.

FIG. 2 shows certain geometrical relationships of two needle sizes representative of the largest and smallest standard needles to be used with the clamp 11 in FIG. 1. FIG. 2 represents an end view of the needle 18 looking directly at the point 27. The outermost circle represents the shank 22, which has the same diameter for all needle sizes to be used with the clamp 11. It is an industry standard that the diameter of the shank 22 is nominally 0.081", or 2.060 mm. The second largest circle represents the blade 26L of a #18 needle and has a diameter of 0.0435"±0.0005" or 1.100 mm. ±0.013 mm. The inner circle represents the diameter of a blade 26S of the smallest standard needle, which is a #9 needle, and has a blade diameter of 0.0275"±0.0005", or 0.700 mm. =0.013 mm.

As is well known, the blade of a sewing machine needle is not absolutely round and of uniform diameter from the constricted end of the tapered section 28 to the beginning of the taper at the point 27; the blade is actually somewhat wider in the region of the eye 30. The exact configuration of the blade 26 is not important in relation to the present invention. What is important is the distance S between a flat plane surface formed on the shank 22 and a plane tangent to the nearest part of the blade. This flat surface on the shank is indicated by reference numeral 31L for the large needle and 31S for the small needle. The distance S is about 0.003", or 0.076 mm., but there are some needles having a clearance above the eye (CAE) that modifies the distance S somewhat. The modified distance is also well known and does not affect this invention in which the clamp 11 can accept needles with or without a CAE.

The reason for maintaining the distance S constant for needles of any size is to place the part of the blade 26 adjacent the eye 30 at a certain distance from the looptaker in a sewing machine so that the looptaker can always pick up a loop at the same location, no matter what size the needle may be. As a result, the cross sectional area of the shank 22 of a #9 needle that has a blade 26S of small diameter is substantially smaller than the cross sectional area of the shank of a #18 needle that has a blade 26L of larger diameter, even though the radius of the round part of the shank of both needles is the same. The difference in cross sectional area is produced by the fact that the flat surface 31S in the #9 needle shank 22 comes closer to the axis than does the flat surface 31L in the shank 22 of the large needle.

The resulting difference in the cross sectional dimension of the shank of needles of different blade size makes it necessary to shape the cross section of the needle channel 19 in FIG. 1 carefully so that it will accept the shank 22 of a large needle but will not be so large as to permit the shank of the small needle to be inserted with the flat surface 31S of the small needle facing away from the flat surface 21 of the needle channel. As an aid in fixing the location of the needle 18 in the needle channel 19, the needle channel is formed with a second flat surface 32. This surface is diagrammatically indicated in FIG. 2 in order to illustrate that it is at a 30° angle with respect to a line perpendicular to the flat surface against which either the flat surface 31S of the small needle or 31L of the large needle is pressed.

FIG. 3 shows the needle clamp 11 and the lower end of the needle bar 14 with part of the material broken away to show the interior configuration. As in customary, the needle bar 14 has a central bore 33 to reduce its weight, but contrary to the usual practice, this bore does not extend entirely through the needle bar 14. The lowermost end 34 of the needle bar is left solid so that a transverse threaded hole 36 can be formed therein to receive the threaded part 37 of the screw 16 that holds the clamp 11 firmly in place on the needle bar 14.

The lower end of the needle bar 14 requires very little machining: no longitudinal slot to receive the shank of a needle and no transverse slot to receive a gib. The gib, itself, is unnecessary, as is the tedious assembly process.

The cylindrical section 13 of the needle clamp 11 has a clearance hole 38 through one side of it, preferably with the axis of the transverse hole intercepting the axis of the cylindrical section 13. In any event, the axis of the hole 38 must be made to coincide with the axis of the threaded hole 36 in the lower end 34 of the needle bar 14. The cylindrical part 13 of the needle clamp has an internal step 41 that serves as a guide in attaching the clamp 11 to the needle bar 14. The step 41 is brought into contact with the end surface 42 of the needle bar 14 to determine the limit of movement of the clamp 11 onto the bar.

As may be seen in FIG. 3, the end 43 of the needle shank 22 butts against the surface 42 of the needle bar 14. This provides a specific determination of the location of the needle 18, as is necessary to be certain that the eye 29 is at the proper longitudinal position with respect to the looptaker in the sewing machine. Although the looptaker and the rest of the machine are not shown in the drawing, the relationship between the location of the looptaker and the eye of the needle is well known.

The embodiment of the clamp 11 in FIG. 3 includes a thread guide 43. Since the entire clamp 11 is die cast, the thread guide may be formed simultaneously as part of the casting. It extends down below the bottom level of the main part of the body portion 12, and its lower edge is substantially coplanar with that of a short, cylindrical extension 44 immediately around the needle channel 19.

FIG. 4 shows a bottom view of the needle clamp 11, and displays the entire thread guide 43. As may be seen, this guide extends along one edge 44 of the body portion 12 and part way along another edge portion that forms a continuation of the surface 15.

FIG. 4 shows the configuration of the needle channel 19. This channel has the straight side 21 at a standard angle of about 4° 20′+20′ with respect to the longitudinal direction of the lug 24. It also has the second flat side 32 at an angle of 60° with respect to the side 21. At the intersection of those two sides, and in order to keep from having too sharp an intersection, there is a third flat surface 46 perpendicular to the side 21. The distal edges of the surfaces 21 and 33 are joined together by a cylindrical surface 47 that has a radius of about 0.041″±0.0005″, or 1.040 mm ±0.012 mm., which is slightly larger than the radius of the shank 22 shown in cross section in position in the needle channel 19. The perpendicular distance from the plane of the flat surface 33 to the axis of the cylindrical surface 47 is about 0.041″±0.0005″, or 1.040 mm. ±0.012 mm., which means that the cylindrical surface 47 is tangent to the flat surface 33. The perpendicular distance from the flat surface 46 to the same axis is about 0.053″±0.001″, or 1.340 mm. ±0.032 mm.

The shank illustrated in FIG. 4 represents the shank of the large needle, such as the size #18. As may be seen, this shank substantially fills the needle channel 19. A shank for a #9 needle would, as may be determined from FIG. 2, not fill up as much of the channel 19, and the axis of the round part of the shank of a #9 needle would be slightly to the left of the axis of the shank 22 of the #18 needle. In any case, a conical end 47 of the screw 23 presses against a part of the rounded surface of the shank 22 and forces another part of the rounded surface against the flat surface 33 and also forces the flat surface 31 of the shank 22 against the flat surface 21 of the needle channel 19 so that the shank will always, for any needle from a #9 to a #18, be properly oriented.

FIG. 5 shows the entire construction of the clamp 11, including particularly the arrangement of the needle channel 19 formed by the flat surfaces 21, 33, and 46 and the rounded surface 47. The tapered end 49 of a hole 51 threaded in the region 52 to hold the screw 23 extends slightly past the place at which the hole 51 intersects the needle channel 19. This assures that the tapered end 48 of the screw 43 can engage the shank of any needle inserted into the needle channel 19.

It is preferable to die cast the clamp 11 out of zinc, but it is also possible to make it of other materials. Most of the clamp 11 is not subjected to any abrasion, but the external surface of the cylindrical lug 24 may be. There are several attachments commonly used with sewing machines and operated by engagment between an arm of such attachment and the cylindrical surface of the lug 24. A suitable protective coating for the outer surface of the lug 24, and one that improves the appearance of the entire clamp 11, is a layer of chromium plated over the entire external surface of the clamp. This allows the surface of the lug to stand up under such abrasive wear as is likely to occur when it is used to drive any of the attachments commonly provided with household sewing machines.

We claim:

1. Needle support means for supporting, in a sewing machine, a needle having a shank including a flat slab surface, the support means comprising:

a needle clamp comprising a main body portion having a needle-receiving end and a needle bar-receiving end, the needle bar-receiving end having a first cylindrical recess extending longitudinally into the main body portion to fit onto the end of a needle bar, and the needle-receiving end having a needle channel that extends longitudinally through the main body portion from the needle-receiving end to the recess in the needle bar-receiving end, the needle channel being defined by surfaces extending longitudinally into the main body portion and comprising a first flat surface in a first longitudinal plane, a second flat surface in a second longitudinal plane at an acute angle to the first flat surface, and a cylindrical surface segment joining distal edges of the first and second flat surfaces, the radius of curvature of the cylindrical segment being greater than the radius of curvature of the standard sewing machine needle but less than a radius that would permit the shank of the smallest sewing machine needle that is to be used in the needle bar clamp to be inserted into the needle channel in any orientation other than with the flat slab surface of the needle shank in flat surface-to-surface contact with the first flat surface of the needle channel;

a hole in the needle bar-receiving end of the needle extending transversely with respect to the axial direction of the needle bar recess;

a first screw extending through the transverse hole to be threaded into a hole aligned therewith near the end of the needle bar to hold the needle clamp on the end of the needle bar; and a side lug extending from one side of the main body portion of the needle clamp and having an internal thread along part of its length to receive a needle-holding second screw threaded into the side lug and comprising a conical point engaging a curved portion of the needle shank to press the needle shank against both the first and second flat surfaces of the needle channel.

2. The needle support means of claim 1 in which the needle bar-receiving end is in the form of a hollow cylinder having an internal diameter just slightly larger than the external diameter of the end of the needle bar, whereby the end of the needle bar can fit snugly into the needle bar-receiving cylinder, one part of the outer surface of the needle bar-receiving cylinder being flattened perpendicular to the axis of the transverse hole to increase the area of contact between the needle bar-receiving cylinder and the head of the first screw.

3. The needle support means of claim 2 in which the needle clamp is die cast to have an internal shoulder at the inner end of the needle bar-receiving end against which the end of the needle bar can abut for location of the clamp on the bar.

4. The needle support means of claim 1 in which the end of the needle bar that extends into the needle bar-receiving end of the main body portion is flat and substantially perpendicular to the axis of the needle bar to serve as an abutment surface for the end of the needle inserted into the needle channel.

5. The needle support means of claim 4 in which the needle bar has the threaded hole aligned with the transverse hole to receive the first screw, and there is a solid portion of the needle bar between the threaded hole and the end surface against which the end of the needle abuts.

6. Needle support means for supporting, in a sewing machine a needle having a blade that defines the needle size and a shank in the form of a generally round cylinder with a flat, slab surface parallel to the axis of the cylinder and spaced from the axis by a predetermined distance proportional to the size of the needle, the support means comprising:

a needle bar in the form of a round cylinder hollow at one end and solid at the other end, the cylinder comprising a transverse threaded hole between the hollow portion of the needle bar and the end surface of the solid end, the end surface being perpendicular to the axis of the needle bar;

a die cast zinc needle clamp comprising a main body portion having a needle-receiving end and an opposite end, a hollow cylinder extending from the opposite end and having an internal diameter just slightly larger than the diameter of the solid end of the needle bar to receive the solid end of the needle bar, an internal shoulder within the needle clamp to limit the extent of insertion of the needle bar into the hollow cylinder, a cylindrical needle channel extending from the needle-receiving end into communication with the hollow cylinder and defined by surface extending longitudinally into the main body portion and comprising a first flat surface in a first longitudinal plane, a second flat surface in a second longitudinal plane at an acute angle to the first flat surface, and a cylindrical surface segment joining distal edges of the first and second flat surfaces, the radius of curvature of the cylindrical segment being greater than the radius of curvature of a standard sewing machine needle shank but less than a radius that would permit the shank of the smallest sewing machine needle that is to be used in the needle bar clamp to be inserted into the needle channel in any orientation other than a predetermined one, the proper orientation of each needle shank in the needle channel being such that the flat slab surface of the needle shank is in surface-to-surface contact with the first flat surface of the needle channel;

a transverse hole extending through one portion of the wall of the hollow needle bar-receiving cylinder, the transverse hole through the needle bar being aligned with the transverse hole in the needle bar-receiving cylinder when the needle clamp is fully inserted onto the end of the needle bar;

a first screw extending through the transverse hole in the needle bar-receiving cylinder and threaded into the transverse hole in the needle bar to hold the needle clamp on the end of the needle bar;

a side lug extending from one side of the main body portion of the needle clamp and having an internal thread along part of its length to receive a needle holding second screw threaded into the side lug and comprising a conical point engaging a curved portion of the needle shank to press the needle shank against both the first and second flat surfaces of the needle channel to hold the needle firmly in place in the needle channel; and a hard chromium plating on the external surface of the clamp.

7. The needle support means of claim 6 comprising, in addition, a thread guide formed integrally as part of the main body portion and comprising a first portion extending from one edge of the main body portion away from the hollow, needle bar-receiving cylinder as a wall extending from the main body portion, the thread guide further comprising a second portion extending perpendicularly to the first portion and generally along a second edge of the main body portion perpendicular to the edge from which the first thread guide portion extends, the second thread guide portion being completely separated from the main body portion by a slot, said slot extending into the first thread guide portion part of the way.

* * * * *

UNITED STATES PATENT OFFICE

CERTIFICATE OF CORRECTION

Patent No. 4,242,975 Dated January 6, 1981

Inventor(s) Warren D. Knowles and Lionel J. Coulombe

It is certified that error appears in the above-identified patent and that said Letters Patent are hereby corrected as shown below:

Column 4, line 2, delete "=" and insert -- ± -- .

Column 4, line 10, delete "S" and insert -- S -- .

Column 4, line 14, delete "S" and insert -- S -- .

Column 4, line 16, delete "S" and insert -- S -- .

Column 4, line 20, delete "S" and insert -- S -- .

Column 7, line 47, delete "surface" and insert -- surfaces --.

Signed and Sealed this

*Second* Day of *June 1981*

[SEAL]

*Attest:*

RENE D. TEGTMEYER

*Attesting Officer* *Acting Commissioner of Patents and Trademarks*